US006844060B2

(12) United States Patent
Reinehr et al.

(10) Patent No.: US 6,844,060 B2
(45) Date of Patent: Jan. 18, 2005

(54) ELASTANE YARN HAVING A LINEAR DENSITY OF AT LEAST 2500 DTEX AND A CROSS-SECTIONAL WIDTH TO HEIGHT RATIO OF AT LEAST 4:1

(75) Inventors: Ulrich Reinehr, Dormagen (DE); Tilo Sehm, Düsseldorf (DE); Wolfgang Anderheggen, Dormagen (DE); Toni Herbertz, Dormagen (DE)

(73) Assignees: Bayer Aktiengesellschaft, Leverkusen (DE); Bayer Faser GmbH, Dormagen (DE)

( * ) Notice: Subject to any disclaimer, the term of this patent is extended or adjusted under 35 U.S.C. 154(b) by 0 days.

(21) Appl. No.: 10/425,457

(22) Filed: Apr. 29, 2003

(65) Prior Publication Data

US 2003/0203197 A1 Oct. 30, 2003

Related U.S. Application Data

(62) Division of application No. 09/720,708, filed as application No. PCT/EP99/04180 on Jun. 17, 1999, now Pat. No. 6,602,453.

(30) Foreign Application Priority Data

Jun. 30, 1998 (DE) ..... 198 29 063

(51) Int. Cl.[7] ..... D01G 6/00; D01G 3/00
(52) U.S. Cl. ..... 428/364; 428/394
(58) Field of Search ..... 428/364, 394

(56) References Cited

U.S. PATENT DOCUMENTS 3,526,689 A 9/1970 Jones et al. ..... 264/103
3,788,365 A 1/1974 Campbell et al. ..... 139/421
4,679,554 A 7/1987 Markham ..... 602/70
5,007,193 A 4/1991 Goodley et al. ..... 43/42.28
5,670,105 A 9/1997 Reinehr et al. ..... 264/210.5
6,492,021 B1 * 12/2002 Reinehr et al. ..... 428/364

FOREIGN PATENT DOCUMENTS

DE 44 22 772 A1 1/1994 ..... D01F/7/70
DE 195 04 316 C1 8/1996 ..... D01D/5/06

OTHER PUBLICATIONS

F. Fourne Chemiefasern/Textilinodustrie 44/96; Jun. 1994, p. 392.
P.A. Koch Faserstoff–Tabellen in Chemiefasern/Textilindustrie, Feb. 1979, p. 100.

* cited by examiner

*Primary Examiner*—N. Edwards
(74) *Attorney, Agent, or Firm*—Norris McLaughlin & Marcus PA

(57) ABSTRACT

Described are a process for producing elastane yarn having a linear density of at least 2500 dtex by the wet spinning process and the thereby producible coarse linear density elastane yarn having a wide cross section and a low residual solvent content. The process comprises the steps of spinning an up to 35% strength by weight stable-viscosity elastane solution into a coagulation bath, washing and optionally drawing, drying by contact heating, setting, spin finishing and winding the yarn, the filaments leaving the coagulation bath passing around a diverting roller disposed just above the coagulation bath liquid, the as-spun filament linear density amounting to not more than 1% of the value of the final linear density, the jet stretch ratio being within the range from 0.5 to 50, the contact heating temperature being at least 220° C. and the contact time of the elastane yarn being at least 2 seconds.

17 Claims, No Drawings

ELASTANE YARN HAVING A LINEAR DENSITY OF AT LEAST 2500 DTEX AND A CROSS-SECTIONAL WIDTH TO HEIGHT RATIO OF AT LEAST 4:1

This application is a division of U.S. application Ser. No. 09/720,708, filed Dec. 29, 2000 now U.S. Pat. No. 6,602, 453, which is a 371 of PCT/EP99/04180, filed Jun. 17, 1999 (PCT filing date), now pending.

The invention relates to a process for producing elastane yarn having a linear density of at least 2500 dtex by the wet spinning process and the thereby producible coarse linear density elastane yarn having a wide cross section and a low residual solvent content. The process comprises the steps of spinning an at least 25% strength by weight stable-viscosity elastane solution into a coagulation bath, washing and optionally drawing, drying by contact heating, setting, spin finishing and winding the yarn, the filaments leaving the coagulation bath passing around a diverting roller disposed just above the coagulation bath liquid, the as-spun filament linear density amounting to not more than 1% of the value of the final yarn linear density, the jet stretch ratio being within the range from 0.5 to 50, the contact heating temperature being at least 220° C. and the contact time of the elastane yarn being at least 2 seconds.

BACKGROUND OF THE INVENTION

Elastane yarns are synthetic filament yarns which are produced as mono- or multifilaments—dependent on the intended use—within the linear density range from 11 to 2500 dtex (cf. F. Fourne: Chemiefasern/Textilindustrie 44/96; June 1994, page 392). Higher linear densities, which extend more or less into the typical application range of natural rubber yarns, are perfectly interesting, however, for example for use as elastic undertapes for upholstery fabrics or as leg border for underwear and swimwear articles and also for the medical and technical sector.

However, the need to evaporate the spinning solution solvent in the spinning chimney imposes technical limits on producing coarse elastane linear densities by the dry spinning process. Owing to the high linear density of 2500 dtex or more and the small yarn surface area of coarse linear densities, it is very difficult to evaporate sufficient spinning solution solvent in order that the yarn may be drawn off without sticking together. Droplets of the spinning solution solvent still present at the down-stream end of the spinning chimney lead to stuck-together filaments which, after winding onto bobbins, are no longer satisfactorily processible off the bobbins. Furthermore, without incurring reduced spinning efficiency due to a reduction in the spinning speed, it is very difficult to lower the residual solvent content in the elastane yarn to a minimum without further cost-intensive steps, such as washing or steaming of the yarn.

By using a lower spinning speed it is possible to increase the residence time in the dry spinning chimney and to reduce the residual level of, for example, dimethyl-acetamide (DMAC) solvent. However, this is at the expense of the spinning efficiency. Nor is it possible to raise the temperature in the spinning chimney to beyond a certain level, since this may give rise not only to discolourations but also to softening and melting of the yarn. The softening range of elastane yarn varies with the polymer composition, but is typically 180–230° C., and the melting range is about 250–270° C.

For this reason, in the field of the dry spinning of elastane yarn, yarn having a final linear density of above 2500 dtex has not been disclosed before. A fineness of up to 3240 dtex has been reported by Globe Manufacturing Comp. for elastane yarn reactively spun by the chemical spinning process, and a linear density of up to 2464 dtex has been reported by Fujibo Spandex for elastane yarn produced by wet spinning. Compare P. A. Koch: Faserstoff-Tabellen in Chemiefasern/Textilindustrie, February 1979, page 100.

In order that elastane yarn may be further processible, for example in ribbon weaving, they must have a certain minimum strength. A tenacity of at least about 0.4–0.5 cN/dtex is required in the case of coarse linear densities to meet these demands.

However, in the case of elastane yarn having a coarse linear density of greater than 2500 dtex it is very difficult to achieve adequate strength, since the higher level of residual solvents, for example dimethylacetamide, which act as plasticizer between the polymer chains, markedly reduce the yarn's strength.

It is an object of this invention to develop elastane yarn and a process for its production which meet the abovementioned requirements and more particularly to provide a high final linear density elastane yarn which has a low residual solvent content, high strength and high residual extensibility.

SUMMARY OF THE INVENTION

This object is achieved according to the invention by a process for producing wet-spun elastane yarn comprising the steps of: spinning an at least 25% strength by weight, preferably at least 30% strength by weight, stable-viscosity elastane solution into a coagulation bath to form a set of filaments, washing and optionally drawing, drying the converged set of filaments by contact heating to form elastane yarn, setting, spin finishing and winding the elastane yarn with a final linear density of at least 2500 dtex, preferably 3500 dtex to 20,000 dtex, more preferably 4000 dtex to 15,000 dtex, the filaments leaving the coagulation bath being passed around a diverting roller disposed just above the coagulation bath liquid, characterized in that a) the as-spun filament linear density is not more than 1% of the value of the final linear density of the yarn, b) the jet stretch ratio of the yarn is within the range from 0.3 to 50, preferably within the range from 0.5 to 50, c) the contact heating temperature is at least 220° C., preferably at least 230° C., especially at least 250° C., more preferably at least 260° C., and d) the contact time between the elastane yarn and the heating medium of the contact heating is at least 2 seconds, preferably at least 3 seconds, especially at least 5 seconds.

DETAILED DESCRIPTION

Preferably, the contact heating used is a heating means featuring heated rollers.

It is particularly advantageous to dry the elastane yarn in a heating means which utilizes an electrically heated roller combined with an unheated idling roller.

The temperature at the surface of the heating roller is to be particularly within the range from 250 to 280° C., particularly preferably within the range from 260 to 270° C.

Particularly good results are obtained when the contact time of the yarn on the heating roller is 10 to 30 seconds, preferably 10 to 15 seconds.

It was found that the wet spinning process of the invention makes it possible to produce elastane yarn having a final linear density of far in excess of the previously known limit of 2464 dtex whilst obtaining a tenacity of distinctly above 0.4 cN/dtex, an extensibility of above 500% and a residual solvent content below 0.5% by weight.

The invention also provides elastane yarn having a final linear density of at least 2500 dtex, especially 3500 dtex to 20,000 dtex, more preferably within the range from 4000 dtex to 15,000 dtex, and a ribbony cross section, characterized in that the ratio of width to height in the cross section through the yarn is at least 4:1, especially at least 8:1, more preferably at least 10:1.

The elastane yarn has in particular a very low residual solvent content. The residual solvent content of the yarn is less than 1.0% by weight, preferably less than 0.5% by weight, more preferably less than 0.3% by weight at a final linear density of up to 5000 dtex.

The residual solvent content of the yarn is less than 2.0% by weight, preferably less than 1% by weight, more preferably less than 0.6% by weight, at a final linear density of 5000 to 10,000 dtex.

The residual solvent content of the yarn is less than 3.0% by weight, preferably less than 1.5% by weight, more preferably less than 1% by weight, at a final linear density of more than 10,000 dtex.

Preferred elastane yarn has a tenacity of at least 0.4 cN/dtex, preferably at least 0.5 cN/dtex.

Preferred elastane yearn has an extensibility of at least 500%, preferably at least 550%.

Of particular interest is elastane yarn which has a ribbony cross section, the width of the yarn in cross section being greater than 1.5 mm, preferably greater than 2 mm. The thickness of the yarn having a ribbony cross section is greater than 0.1 mm, preferably greater than 0.2, in cross section.

As the individual Examples will additionally illustrate, the disclosed parameters for the process of the invention must be adhered to so as to also obtain continuous yarn running whilst achieving good yarn data.

If, for example, the as-spun filament linear density (ASFLD) rises to far above 1% of the value of the final yarn linear density, broken ends may occur on the heating roller (cf. Example 9 in Table 2). On further increasing the as-spun filament linear density, the yarn can no longer be placed on the heating roller, since yarn is constantly breaking on the healing roller (cf. Example 10 in Table 3).

To obtain a yarn tenacity of at least 0.4 cN/dtex, the jet stretch ratio should be at least 0.5. A lower jet stretch ratio may in certain circumstances not provide the desired yarn tenacity (cf. Examples 11 and 12 in Table 3). Similarly, the setting temperature and the contact time for the yarn on the heating roller plays an essential part in relation to the yarn tenacity and the remaining residual solvent content in the case of coarse linear density elastane yarn.

As is discernible from Table 4, even a setting temperature of 260° C. and a contact time of below 5 seconds may in certain circumstances not provide optimal yarn strength in the case of elastane yarn having a linear density of 3000 dtex (cf. Example 20 in Table 4). Only a contact time of not less than about 5 seconds and a setting temperature of least 250° C. will provide in such a case a yarn tenacity of 0.4 cN/dtex or more (cf. Example 19 in Table 4). In the case of coarser linear densities than 3000 dtex, the contact time for the elastane yarn on the heating roller and possibly also the setting temperature may have to be raised in certain cases to obtain a particular yarn strength. For instance, a linear density of 7381 dtex requires a contact time of 14.8 seconds in the case of setting temperatures of 260/265/270° C. for zones 1–3 of the heating roller to obtain a yarn tenacity of 0.67 cN/dtex (cf. Example 1 and Table 4, Example 21).

In general, the elastane yarn can be set on one or else two pairs of electrically healed rollers, for example in accordance with an arrangement as in FIGS. 1a-1d of OP1 document DE 195 04 316. In the present case, it is particularly the arrangement of FIG. 1a of DE 195 04 316, featuring an electrically heated roller and an adjustable idling roller, which has proven to be particularly advantageous. To set the temperature profile mode on the heating roller, use is preferably made of godets having radiative heating elements and adjustable shrouds as are fundamentally known in the art.

It is important for the drawing of the elastane yarn to take place between the washing and the drying of the yarn. Otherwise, nonuniform yarn material having reduced quality, linear density fluctuations, i.e. an increase in the coefficient of variation of linear density, strength and extensibility, is observed.

The process of the invention preferably utilizes elastane polymers containing at least 85% by weight of segmented polyurethane.

Segmented polyurethanes are for example segmented polyurethanes based on polyethers, polyesters, polyetheresters, polycarbonates or mixtures thereof.

Elastane yarn according to the invention is used both in the textile and in the nontextile sector, for example as elastic undertapes for upholstery fabrics or as leg border for underwear and swimwear articles e.g. disposable diapers, and also for articles from the medical and technical sector.

In the examples hereinbelow, parameters reported include the as-spun filament linear density.

The as-spun filament linear density (ASFLD) is calculated as follows:

$$ASFLD = \frac{F \times K \times 0.94 \times 100}{A \times Z}(dtex)$$

F=pumpage rate (ccm/min)

K=concentration of spinning solution (% by weight)

A=coagulation bath speed (m/min)

Z=number of jet holes

The jet stretch ratio (V) is defined as the ratio of the take-off speed (A) to the extrusion speed (S)

$$V = \frac{A(m/\min)}{S(m/\min)}$$

The extrusion speed (S) is given by:

$$S = \frac{4 \times F(m/\min)}{Z \times d^2 \times \pi \times 100}$$

F=pumpage rate (ccm/min)

Z=number of jet holes d=jet hole diameter (cm)

The take-off speed (A) corresponds to the speed of the yarn after leaving the heating roller.

The examples which follow serve to illustrate the invention. Percentages are based on the weight of the finished elastane yarn, unless otherwise stated.

The determination of the yarn tenacity (in cN/dtex) and of the ultimate tensile strength extension (in %) was effected on the lines of the standard DIN 52815, the yarn data being measured, given the coarse linear densities, using a large-scale instrument from Wolpert, having a measuring range of up to 200 newton per yarn.

EXAMPLES

Example 1

A 29.5% strength by weight elastane spinning solution prepared according to Example 7 of DE-05 4 222 772, the spinning solution having been pretreated with 0.5% of diethylamine at 140° C. for about 10 min and having a spinning viscosity of 22 Pa.s measured at 50° C., was spun through two 397 hole jets having jet hole diameters of 0.1 mm into a coagulation bath containing 25.2% strength DMAC-water mixture at 85° C. The ends were converged via a yarn holder disposed at a distance of 500 mm from the jets, taken off at 80 m/min via a diverting roller disposed just above the coagulation bath liquid, coalesced and washed in a wash bath featuring a pair of wash rollers featuring a press roller for the ends and at 120 m/min set on a heating roller and spin finished, and the folded yarn was wound up on a bobbin. The pumpage rate of the spinning pump supplying the two jets was 319.4 ccm/min. The as-spun filament linear density (ASFLD) is 13.9 dtex, which corresponds to 0.19% of the value of the final yarn linear density. The jet stretch ratio was 1.6.

The yarn was transported via a heating roller (subdivided into different temperature zones) combined with an unheated idling roller, the temperatures being 260° C. in zone 1, 265° C. in zone 2 and 270° C. in zone 3, by wrapping the two rollers 52 times, which corresponds to a contact time of 14.8 seconds.

The elastane yarn obtained had a final linear density of 7381 dtex, a tenacity of 0.67 cN/dtex, an extensibility of 636% and a residual level of 0.16% for the DMAC spinning solution solvent. The elastane yarn is present in the form of a continuous-surface ribbon. Ribbon width is about 5 mm and ribbon thickness 0.42 mm.

TABLE 1

| No. | Number of jet holes | Jets Ø mm | Pumpage rate cc m/min | Coagulation bath speed m/min. | Heating roller speed m/min | ASFLD dtex | Final yarn linear density dtex | ASFLD as %age of final yarn linear density | Jet stretch ratio | Yarn Tenacity cN/dtex | Extensibility % | Residual DMAC Content % |
|---|---|---|---|---|---|---|---|---|---|---|---|---|
| 1 | 2 × 397 | 0.1 | 319.5 | 80 | 120 | 13.9 | 7381 | 0.19 | 1.6 | 0.67 | 636 | 0.14 |
| 2 | 397 | 0.1 | 180.5 | 80 | 120 | 15.8 | 4178 | 0.38 | 1.4 | 0.67 | 617 | 0.19 |
| 3 | 2 × 397 | 0.1 | 234.5 | 60 | 120 | 13.6 | 5402 | 0.25 | 1.6 | 0.63 | 718 | 0.16 |
| 4 | 2 × 397 | 0.1 | 281.5 | 60 | 120 | 16.4 | 6448 | 0.25 | 1.3 | 0.61 | 679 | 0.18 |
| 5 | 4 × 300 | 0.1 | 349.7 | 50 | 120 | 16.2 | 8081 | 0.2 | 1.3 | 0.55 | 583 | 0.21 |
| 6 | 4 × 300 | 0.1 | 467.5 | 50 | 120 | 21.6 | 10,801 | 0.2 | 1 | 0.54 | 562 | 0.23 |

Examples 2–6

Table 1 below summates further Examples (Nos. 2–6) relating to the production of coarse linear density elastane yarn by the process of the invention. In all cases, an elastane polymer having the chemical composition of Example 1 was dissolved in DMAC and a spinning solution was spun as described therein. The resulting yarns were washed, set, spin finished and wound up, all steps being carried out as described in Example 1.

In all cases, yarn tenacity was at least 0.4 cN/dtex and yarn extensibility a least 500%. The residual DMAC content of the yarn was below 0.30% by weight based on polymer solids. According to Table 1, it is possible to produce elastane yarn of 10,000 dtex or more.

Examples 7 and 8, and comparative Example 9

A portion of the spinning solution of Example 1 is spun into 7300 dtex elastane yarn as described in Example 1, except that the two 397 hole jets are replaced by a single jet of 175–350 holes and a bore diameter of 0.15 mm. The speed in the coagulation bath was 50 instead of 80 n/min. As is discernible from Table 3, problems in the form of broken ends keep on occurring in the setting process on the heating roller whenever the value of the as-spun filament linear density is more that 1% of the final yarn linear density (cf. Examples Nos. 7 and 8, which are according to the invention and Example 9 which is not according to the invention, in Table 2), i.e. whenever the as-spun filament linear density is too high.

TABLE 2

| No. | Number of jet holes | Jets Ø mm | Pumpage rate ccm/min | Coagulation bath speed m/min | Heating roller speed m/min | ASFLD dtex | Final yarn linear density dtex | ASFLD as %age of final yarn linear density | Jet stretch ratio | Yarn tenacity cN/dtex | Extensibility % | Yarn running |
|---|---|---|---|---|---|---|---|---|---|---|---|---|
| 7 | 350 | 0.15 | 319.4 | 50 | 120 | 50.6 | 7301 | 0.7 | 1 | 0.64 | 644 | o.k. |
| 8 | 250 | 0.15 | 319.4 | 50 | 120 | 70.9 | 7330 | 1 | 0.7 | 0.61 | 603 | o.k. |
| 9 | 200 | 0.15 | 319.4 | 50 | 120 | 88.6 | 7298 | 1.2 | 0.6 | 0.563 | 617 | occasional breakages on heating roller |

Examples 10–14

A further portion of the spinning solution of Example 1 is spun into 7300 dtex elastane yarn as described in Example 1, except that the 397 hole jets used have a finer bore diameter (0.08 instead of 0.1 mm) in some cases and the filaments are spun at lower speeds in the coagulation bath (25–40 m/min instead of 80 m/min). As is discernible from Table 3, jet stretch ratios of less than 0.5 no longer ensure an adequate yarn strength of at least 0.4 cN/dtex (cf. Examples Nos. 10 and 11 in Table 3).

TABLE 3

| No. | Number of jet holes | Jets Ø mm | Pumpage rate ccm/min | Coagulation bath speed m/min | Heating roller speed m/min | ASFLD dtex | Final yarn linear density dtex | ASFLD as %age of final yarn linear density | Jet stretch ratio | Yarn tenacity cN/dtex | Extensibility % |
|---|---|---|---|---|---|---|---|---|---|---|---|
| 10 | 2 × 397 | 0.08 | 319.4 | 25 | 120 | 44.6 | 7385 | 0.6 | 0.3 | 0.33 | 633 |
| 11 | 2 × 397 | 0.08 | 319.4 | 35 | 120 | 31.9 | 7309 | 0.4 | 0.4 | 0.39 | 674 |
| 12 | 2 × 397 | 0.08 | 319.4 | 40 | 120 | 27.9 | 7294 | 0.4 | 0.5 | 0.44 | 666 |
| 13 | 2 × 397 | 0.1 | 319.4 | 25 | 120 | 44.6 | 7390 | 0.6 | 0.5 | 0.41 | 641 |
| 14 | 2 × 397 | 0.1 | 319.4 | 35 | 120 | 31.9 | 7288 | 0.4 | 0.7 | 0.52 | 682 |

Examples 15–21

Another portion of the spinning solution of Example 1 is spun from a 397 hole jet into 3000 dtex elastane yarn as described in Example 1, except that the setting conditions for the elastane yarn on the heating roller are varied according to FIG. 1a. The elastane yarn is passed over the heating roller whilst temperatures and contact times are being varied. Temperature profiles of 230–270° C. are set. Yarn contact time on the heating roller can be varied between about 4.7 seconds and about 9.8 seconds by varying the number of wraps (17 yarn wraps correspond to 4.7 seconds). Table 4 reveals that yarn capabilities greater than 0.4 cN/dtex are obtained only at setting temperatures from about 250° C. and contact times of at least 5 seconds (cf. Examples 15 to 17 and 19 in Table 4).

TABLE 4

| No. | Speed on heating roller m/min | Temperature of heating roller in ° C. Zone 1 | Zone 2 | Zone 3 | Contact time sec | Linear density dtex | Tenacity cN/dtex | Extensibility % |
|---|---|---|---|---|---|---|---|---|
| 15 | 120 | 230 | 240 | 245 | 4.9 | 3070 | 0.31 | 533 |
| 16 | 120 | 230 | 240 | 245 | 9.8 | 3065 | 0.37 | 579 |
| 17 | 120 | 250 | 250 | 250 | 4.7 | 3044 | 0.38 | 566 |
| 18 | 120 | 250 | 250 | 250 | 5.1 | 3071 | 0.41 | 613 |
| 19 | 120 | 250 | 255 | 260 | 4.7 | 3075 | 0.39 | 574 |
| 20 | 120 | 260 | 265 | 270 | 5.1 | 3028 | 0.51 | 649 |
| 21 | 120 | 265 | 270 | 270 | 9.8 | 3019 | 0.71 | 685 |

We claim:

1. Elastane yarn having a final linear density of from 4,000 dtex to 15,000 dtex, and a ribbony cross section, wherein the ratio of width to height in the cross section through the yarn is at least 10:1.

2. Elastane yarn according to claim 1 wherein the residual solvent content of the yarn is less than 1.0% by weight at a final linear density of up to 5000 dtex.

3. Elastane yarn according to claim 1, wherein the elastane yarn has a tenacity of at least 0.4 cN/dtex.

4. Elastane yarn according to claim 1, wherein the elastane yarn has an extensibility of at least 500%.

5. Elastane yarn according to claim 1, wherein the yarn has a ribbony cross section, the width of the yarn in cross section being greater than 1.5 mm.

6. Elastane yarn according to claim 1, wherein the yarn has a ribbony cross section, the thickness of the yarn in cross section being greater than 0.1 mm.

7. Elastane yarn according to claim 1 obtainable by the wet spinning process.

8. Elastane yarn obtainable by a process comprising the steps of spinning an at least 25% strength by weight, stable-viscosity elastane solution into a coagulation bath to form a set of filaments, washing and optionally drawing, drying the converged set of filaments by contact heating to form elastane yarn, setting, spin finishing and winding the elastane yarn with a final linear density of from 4,000 dtex to 15,000 dtex, the filaments leaving the coagulation bath being passed around a diverting roller disposed just above the coagulation bath liquid, wherein a) the as-spun filament linear density is not more than 1% of the value of the final linear density of the yarn, b) the let stretch ratio of the yarn is within the range from 0.3 to 50, c) the contact heating temperature is at least 220° C., and d) the contact time between the elastane yarn and the heating medium of the contact heating is at least 2 seconds.

9. Elastane yarn of claim 2, wherein said residual solvent content is less than 0.3% by weight at a final linear density up to 5000 dtex.

10. Elastane yarn of claim 3, wherein said tenacity is at least 0.5 c/N/dtex.

11. Elastane yarn of claim 4, wherein said extensibility is at least 550%.

12. Elastane yarn of claim 5, wherein said cross section is greater than 2 mm.

13. Elastane yarn of claim 6, wherein said thickness is greater than 0.2 mm.

14. Elastane yarn according to claim 1 wherein the residual solvent content of the yarn is less than 2.0% by weight at a final linear density of between 5000 to 10,000 dtex.

15. Elastane yarn according to claim 14, wherein said residual solvent content is less than 0.6% by weight at a final linear density of between 5000 to 10,000 dtex.

16. Elastane yarn according to claim 1 wherein the residual solvent content of the yarn is less than 3.0% by weight at a final linear density of more than 10,000 dtex.

17. Elastane yarn according to claim 16, wherein said residual solvent content is less than 1% by weight at a final linear density of more than 10,000 dtex.

* * * * *

UNITED STATES PATENT AND TRADEMARK OFFICE

CERTIFICATE OF CORRECTION

PATENT NO. : 6,844,060 B2
APPLICATION NO. : 10/425457
DATED : January 18, 2005
INVENTOR(S) : Reinehr et al.

It is certified that error appears in the above-identified patent and that said Letters Patent is hereby corrected as shown below:

Page 1, Abstract, Delete text of current Abstract and replace with -- Elastane yarn having a wide cross-section, low residual solvent content and a linear density of at least 2500 dtex. --

Column 1, Line 6, "This application is a division of U.S. application Ser. No. 09/720,708, filed Dec. 29, 2000 now U.S. Pat. No. 6,602,453, which is a 371 of PCT/ EP99/04180, filed Jun. 17, 1999 (PCT filing date), now pending" should read --This application is a division of U.S. application Ser. No. 09/720,708, filed Dec. 29, 2000 now U.S. Pat. No. 6,602,453, which is a 371 of PCT/EP99/04180, filed Jun. 17, 1999 (PCT filing date).--

Column 3, Line 27, "elastane yearn" should read -- elastane yarn --

Column 6, Line 4, "a least" should read -- at least --

Column 8, Line 32, "the let stretch ratio" should read -- the jet stretch ratio --

Signed and Sealed this

Twenty-eighth Day of November, 2006

JON W. DUDAS
*Director of the United States Patent and Trademark Office*